United States Patent [19]

Yazaki

[11] Patent Number: 4,583,913

[45] Date of Patent: Apr. 22, 1986

[54] LINER OF A SEMI-AXIAL FLOW PUMP

[75] Inventor: Mitsuhiro Yazaki, Kakogawa, Japan

[73] Assignee: Kawasaki Jukogyo Kabushiki Kaisha, Kobe, Japan

[21] Appl. No.: 655,641

[22] Filed: Sep. 28, 1984

[30] Foreign Application Priority Data

Oct. 3, 1983 [JP] Japan ..... 58-153874[U]

[51] Int. Cl.[4] ..... F04D 29/52; B63H 11/08

[52] U.S. Cl. ..... 415/196; 60/221

[58] Field of Search ..... 415/128, 172 A, 196, 415/197, 213 C; 60/221; 440/38

[56] References Cited

U.S. PATENT DOCUMENTS

| | | | |
|---|---|---|---|
| 1,694,481 | 12/1928 | Moody | 415/128 |
| 3,083,529 | 4/1963 | Hamilton | 440/38 X |
| 3,367,116 | 2/1968 | Stallman | 415/197 X |
| 3,605,672 | 9/1971 | Strumbos | 415/197 X |
| 3,756,741 | 9/1973 | Woell, Jr. | 60/221 X |
| 3,827,390 | 8/1974 | De Vault et al. | 60/221 X |
| 3,957,403 | 5/1976 | Sloan | 415/197 X |

FOREIGN PATENT DOCUMENTS

| | | | |
|---|---|---|---|
| 1808121 | 5/1970 | Fed. Rep. of Germany | 415/172 A |
| 3234370 | 3/1984 | Fed. Rep. of Germany | 440/38 |
| 790854 | 2/1958 | United Kingdom | 415/172 A |

*Primary Examiner*—Robert E. Garrett
*Assistant Examiner*—Joseph M. Pitko
*Attorney, Agent, or Firm*—Leydig, Voit & Mayer

[57] ABSTRACT

In a semi-axial flow pump used in a small-sized boat which is intended to travel in shallow water, a truncated-conical liner of wear-resistant material is force fitted into the inner surface of a passage portion within which an impeller is mounted. The liner has cylindrical portions at its both ends, which are effective to forcibly fit the liner into the pipe passage portion.

1 Claim, 3 Drawing Figures

LINER OF A SEMI-AXIAL FLOW PUMP

BACKGROUND OF THE INVENTION

Field of the Invention

This invention relates to a liner incorporated into a tubular passage of a semi-axial flow pump and, more particularly, to a liner which is most suitably used in a small-sized boat (hereinafter referred to simply as "Jet Ski" which is a registered trademark of the assignee of this application) which is equipped with a water jet type propulsion device using such a semi-axial flow pump.

Generally, in the water jet type propulsion device of a "Jet Ski" which uses a semi-axial flow pump b, as shown in FIG. 3, an impeller c of the pump b is mounted on a driving shaft a extended from a prime mover. A tubular passage d of the pump b has a truncated-conical passage portion e, inside which the impeller c is disposed. The semi-axial flow pump b is arranged such that it imparts pressure energy to a water sucked-in from a suction port f which is opened in that bottom portion of the boat at the position forwardly of the conical pipepassage portion e, said pressure energy in the water being converted into kinetic energy at a pump nozzle g, thereby the water is ejected outside the boat through a steering nozzle h, so that, with the reaction thus produced, a body of the boat is caused to advance or have its advancing direction altered. A vane guide i is connected to a boss k by means of radial stationary vanes j. The boss k interiorly supports the driving shaft a through a bearing l so that that shaft may rotate about its axis. The passage d in the prior art as well is a casting which consists of a light alloy, for purpose of anti-corrosive features and reduced weight. Since the "Jet Ski" equipped with the above-mentioned water jet type propulsion device has no projection from the outer surface of the boat bottom, it can be allowed to travel even in very shallow water. However, when the "Jet Ski" is allowed to travel in shallow water along the seashore, sands and the like are sucked into the suction port f together with water. This raised a problem that when these sands and the like pass through the pump b, they are radially accelerated and moved toward the inner periphery of the pipe passage d, by a centrifugal force, to remarkably wear the inner peripheral wall of the truncated conical pipe-passage portion e made of light alloy.

SUMMARY OF THE INVENTION

The object of this invention is to provide a liner of a semi-axial flow pump which can eliminate the above-mentioned problem of wear.

The basic construction of this invention is characterized in that it is directed to providing a liner, which is adapted to be force fitted into the inner peripheral wall of a tubular passage of a truncated-conical shape of a semi-axial flow pump, and which has a truncated-conical portion at the middle and cylindrical portions at the ends, so as to enable the liner to be effectively force-fitted at the truncated-conical passage.

Other and further objects, features and advantages of the invention will appear more fully from the following description.

DETAILED DESCRIPTION OF THE PREFERRED EMBODIMENT

A embodiment of the invention will now be described with reference to the drawings.

Figure 1:
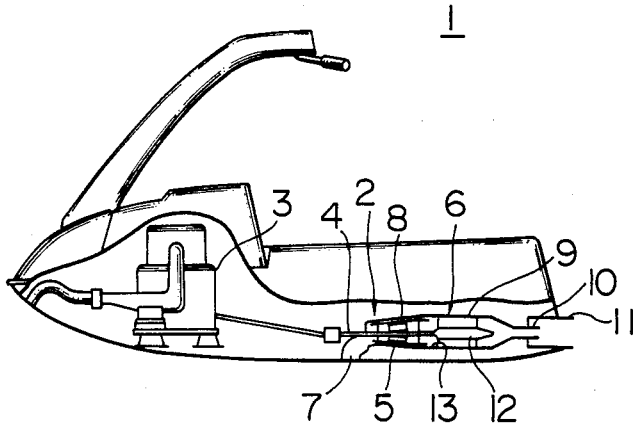
FIG. 1 is a side view, partly broken away, which schematically shows a water jet type propulsion device of a "Jet Ski"

The embodiment concerns a semi-axial flow pump 2 which is used for water-jet type propulsion of the "Jet Ski" (a trademark of the assignee) boat shown in FIG. 1. The semi-axial flow pump 2 is provided with a prime mover 3 mounted within a front portion of the boat body, an impeller 5 caused to rotate through a driving shaft 4 of the prime mover 3, and a pipe passage 6 through which water is ejected.

The passage 6 is formed of anticorrosive light cast alloy (such as, for example, aluminium alloy), and comprises a truncated-conical pipe-passage portion 8 which is continuous to a suction port 7 opened to a bottom of the boat, a vane guide portion 9 and a jet nozzle 10. A steering deflector 11 is provided at the stern of the boat. The driving shaft 4 is rotatably supported at its one end by a boss portion 12 of the vane guide portion 9. The impeller 5 is located inside the truncated-conical passage portion 8 into which a liner 13 is force fitted.

Figure 2:
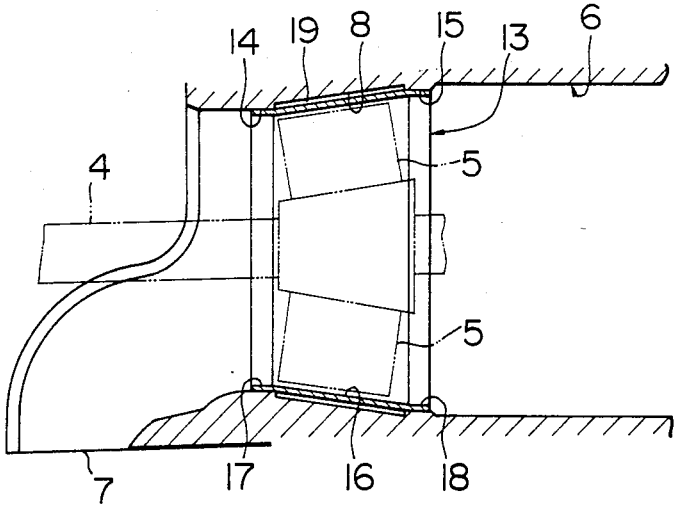
FIG. 2 is an enlarged sectional view of a liner-mounting section of the water jet type propulsion device shown in FIG. 1.
Figure 3:
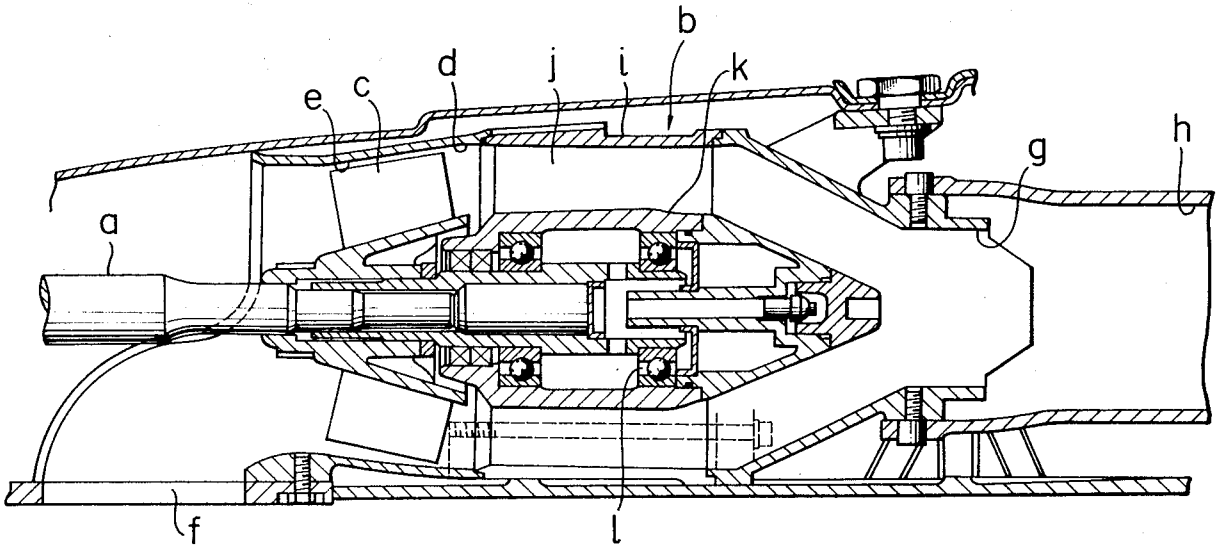
FIG. 3 PRIOR ART
FIG. 3 is a sectional view which shows a prior art semi-axial flow pump.

A detailed structure of the liner-mounting section is shown in FIG. 2. The truncated-conical passage portion 8 is located downstream of the suction port 7, and is circular in cross section with the diameter divergent toward the stern of the boat. The ends of the truncated-conical passage portion 8 are respectively formed cylindrical to constitute a smaller diameter cylindrical pipe-passage portion 14 and a larger diameter cylindrical pipe-passage portion 15, respective inner surfaces of which are made slightly to protrude in the radially inward direction from the inner surface passage portion 8.

The liner 13 is made of anticorrosive and wear-resistant material such as stainless steel, and formed into a hollow body having a truncated-conical portion shaped circular in cross section. The truncated-conical portion 16 is opposite to the above-mentioned truncated-conical passage portion 8 and is provided at its ends with a smaller diameter cylindrical portion 17 and a larger diameter cylindrical portion 18 correspondingly to the cylindrical passage portions 14 and 15, respectively.

The liner 13 is force fitted into the passage 6 from the downstream side thereof. A clearance 19 is formed between the inner surface of the passage portion 8 and the outer surface of the portion 16 of the liner 13. The force-fitting of the liner 13 is effecated between the smaller diameter cylindrical portions 14 and 17 and between the larger diameter cylindrical portions 15 and 18.

If the clearance 19 is not provided and the truncated-conical portion 16 of the liner 13 is allowed to contact with, and abut against, the truncated-conical passage portion 8, then an elastic repulsive force will be produced in this portion 16 to act on the liner 13 to push it backwards. As a result, the force-fitting between the liner 13 and the pipe passage 16 becomes very unreliable. Accordingly, the existance of the clearance 19 is essential.

In this invention having the foregoing construction, the liner is significantly wear resistant by virtue of its selected material, is reduced in weight and cost by virtue of its simple fabrication and assembling for a simple thin tubular structure.

Having described a specific embodiment of our liner, it is believed obvious that modification and variation of our invention is possible in light of the above teaching.

What is claimed is:

1. A semi-axial flow pump for water jet type propulsion device for a boat comprising:

an axial flow passage for ejecting water having a truncated-conical portion forming a recess having an inner peripheral wall diverging toward the stern of the boat, said passage having cylindrical portions adjacent opposite ends of said truncated-conical portion constituting a smaller diameter cylindrical passage portion and a larger diameter cylindrical passage portion, respectively, formed to protrude in the radially inward direction from said truncated-conical portion;

an impeller located inside said truncated-conical portion and mechanically connected to a prime mover for rotating; and a liner for protecting said inner peripheral wall including a hollow tube having a truncated-conical portion and cylindrical portions at both ends of said truncated-conical portion, said liner being force fitted into said axial flow passage with said cylindrical ends adjacent said truncated-conical portion in pressure contact with said cylindrical portions of said liner and providing clearance between said inner peripheral wall and said truncated-conical portion of said liner for preventing said liner from being pushed sternwards due to elastic repulsive force produced by the water forced by the rotation of said impeller.

* * * * *